US005665499A

United States Patent [19]

Dan et al.

[11] Patent Number: 5,665,499

[45] Date of Patent: Sep. 9, 1997

[54] METHOD FOR DEVELOPMENT OF ELECTROPHOTOGRAPHIC PRINTING PLATE PRECURSOR

[75] Inventors: Shigeyuki Dan; Takao Nakayama, both of Shizuoka, Japan

[73] Assignee: Fuji Photo Film Co., Ltd., Kanagawa, Japan

[21] Appl. No.: 712,847

[22] Filed: Sep. 12, 1996

Related U.S. Application Data

[62] Division of Ser. No. 518,336, Aug. 23, 1995, Pat. No. 5,597,671.

[30] Foreign Application Priority Data

Sep. 20, 1994 [JP] Japan ..... 6-225077

[51] Int. Cl.[6] ..... G03G 13/28

[52] U.S. Cl. ..... 430/49; 430/103

[58] Field of Search ..... 430/49, 103

[56] References Cited

U.S. PATENT DOCUMENTS 4,942,104 7/1990 Kitajima et al. ..... 430/56
4,994,342 2/1991 Nakayama et al. ..... 430/49
5,008,167 4/1991 Yu ..... 430/56
5,057,389 10/1991 Nakayama et al. ..... 430/49
5,212,030 5/1993 Figov ..... 430/49

*Primary Examiner*—Roland Martin
*Attorney, Agent, or Firm*—Sughrue, Mion, Zinn, Macpeak & Seas

[57] ABSTRACT

An electrophotographic printing plate precursor having satisfactory mechanical strength and water-resistance and suitable to the direct electrical supply system, and a method for development thereof are disclosed.

The electrophotographic printing plate precursor comprises an electrically conductive support having thereon a photoconductive layer and a back layer, the back layer being provided on the surface of the support opposite to the photoconductive layer, wherein the back layer comprises at least an outermost layer having a surface resistivity of from $1\times10^{10}$ to $1\times10^{14}\Omega$ and an inner layer having a surface resistivity of less than $1\times10^{10}\Omega$.

4 Claims, 1 Drawing Sheet

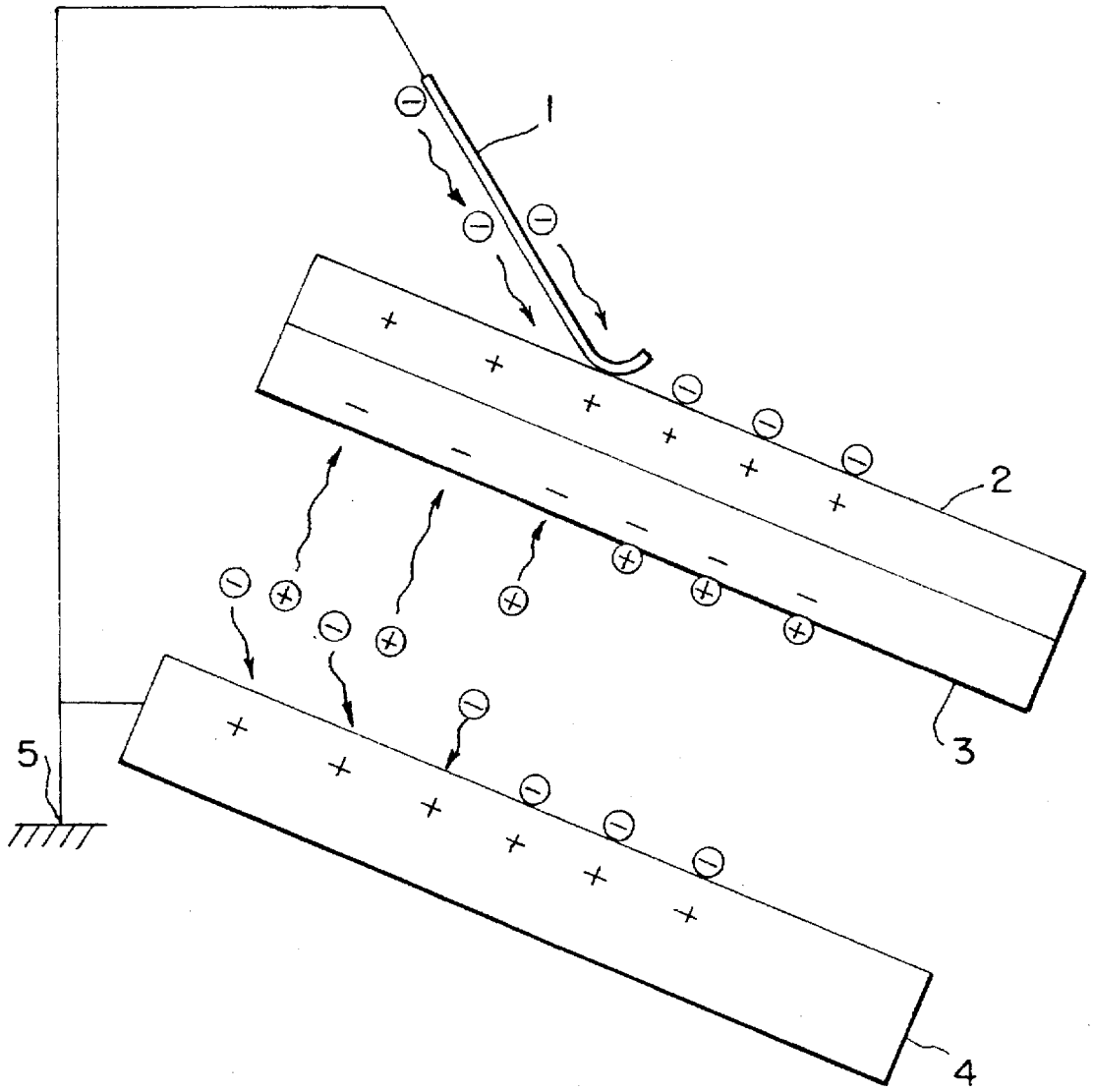
FIGURE

METHOD FOR DEVELOPMENT OF ELECTROPHOTOGRAPHIC PRINTING PLATE PRECURSOR

This is a divisional of application Ser. No. 08/518,336, filed Aug. 23, 1995, now U.S. Pat. No. 5,597,671.

FIELD OF THE INVENTION

This invention relates to an electrophotographic printing plate precursor and a method for development thereof, and, more specifically, it relates to an electrophotographic printing plate precursor which is excellent in the mechanical strength, water-resistance and is suitable to the development in a direct electrical supply system, and a method for development thereof.

BACKGROUND OF THE INVENTION

A typical conventional process which is generally used for producing a printing plate by the electrophotographic method comprises uniformly charging a photoconductive layer of the electrophotographic printing plate precursor, imagewise exposing the photoconductive layer, wet-developing the precursor with a liquid toner to obtain a toner image, fixing the toner image, treating the precursor with a oil-desensitizing solution (an etching solution) to hydrophilize a non-image portion having no toner image.

Hitherto, paper, etc. which has been made electrically conductive has been used as a support for the above-described electrophotographic printing plate precursor, but water-permeability of the support affects the printing ability and photographic performance. More specifically, the above-described etching solution and a fountain solution used during the printing are permeated into the support thereby causing elongation of the support. In some instances, the photoconductive layer is peeled-off from the support thereby decreasing the press life, and the water content in the support is changed depending upon the humidity and temperature conditions in atmosphere during the above-described charging and exposure, and, as a result, the electrical conductance of the support varies and adversely affects the photographic performance of the precursor. Also, lack of water-resistance generates wrinkle during the printing.

In order to solve the above problems, it has been proposed that one or both side surfaces of the support are coated with a water-resistant resin, for example, an epoxy resin or a copolymer of ethylene and acrylic acid as described in, for example, JP-A-50-138904, JP-A-55-105580 and JP-A-59-68753, or a laminate layer such as polyethylene is provided on one or both side surfaces of the support as described in, for example, JP-A-58-57994. (The term "JP-A" as used herein means an unexamined published Japanese patent application.)

A back coating layer provided on the surface (i.e., side) opposite to the surface (i.e., side) having a photoconductive layer of the support (a printing surface or a top surface) is generally called as "a back layer", and various improvements have been made in the composition for forming the back layer for the purpose of maintaining various functions in addition to the above-described function to impart the water-resistance to the printing plate precursor.

On the other hand, the present inventors have developed a wet-development method which is so-called a direct electrical supply system in place of the conventional system in which a master plate is passed into a developing solution flowing between electrodes. In the wet-development by the direct electrical supply system, an electrically conductive element is used in place of the electrode at an opposite side of the printing surface, and the development is conducted while directly supplying electrons from the electrically conductive element to the back surface of the support opposite to the printing surface, as proposed in JP-A-1-26043. By employing this system, a development rate can be increased, a solid image can be formed uniformly, and further adhesion of a toner on the electrode of back side in the developing apparatus can be prevented.

As a printing plate precursor suitable to the direct electrical supply system, the present inventors also proposed that a layer having a surface electric resistance of $1\times10^{10}$ Ω or less and having a frictional resistance higher than that of a polyolefin laminate layer is provided as a back layer of the support which has polyolefin laminate layers on both side surfaces, as described in JP-A-2-84665. By providing the above-described layer, the resulting printing plate can be wound and fixed around a drum of printer precisely, and printing deviation can be prevented whereby a satisfactory electrophotographic printing plate can be obtained, and, at the same time, a printing plate precursor which can be developed by the direct electrical supply system can be produced.

Further, the present inventors proposed a printing plate precursor comprising a support having provided on the surface thereof an underlayer having a surface resistivity of from $1\times10^{8}$ to $1\times10^{14}$ Ω and a photoconductive layer and having provided on the opposite surface thereof a back layer having a surface resistivity of $1\times10^{10}$ Ω or less, as well as a method for the development thereof, as described in JP-A-2-132464. The resulting printing plate precursor can be developed precisely, satisfactory and rapidly by the wet-development process of either the conventional process or the direct electrical supply system and is capable of forming a uniform image without generation of pin-holes in the solid image portion.

However, in the above-described JP-A-2-84665 and JP-A-2-132464, a mechanical strength and the water-resistance of the back layer are deteriorated due to the adjustment of the surface electric resistance of the back layer, thereby causing stains in prints and deterioration of printing plate durability.

Further, JP-A-5-6018 and JP-A-5-6036 propose a back layer composed of a plurality of layers, in which a hydrophilic polymer is incorporated into the outermost layer and a layer having water-resistance is used as an inner layer, and it is described that frictional stains during the storage in a laminated state can be prevented and the printing performance can be improved by imparting the water-resistance.

However, in these techniques, the mechanical strength of the outermost layer is still insufficient due to the adjustment of the surface electric resistance of the back layer, and pieces of the back layer peeled-off are transferred to the photoconductive layer thereby causing stains of prints.

Accordingly, at present there are no electrophotographic printing plate precursors and the method of development thereof which satisfy all the requirements of mechanical strength, the water-resistance and the adaptability to a development by the direct electrical supply system.

As a result of extensive studies in order to solve the above problems, the present inventors found that, when the back layer is composed of at least two layers, with the inner layer thereof having a lower electric resistance and the outermost layer having an electric resistance higher than that of the inner layer, the resulting printing plate precursor can be sufficiently developed by the direct electrical supply system as long as the inner layer has a low resistance even if a layer having a certain degree of high resistance is present thereon, and is excellent in the mechanical strength and the water-resistance while enjoying an advantage of the direct electrical supply system.

More specifically, according to the present invention, it was found that an electrophotographic printing plate precursor which is excellent in the water-resistance and the mechanical strength, which is capable of forming a uniform image and which is suitable to the development by the direct electrical supply system can be obtained.

SUMMARY OF THE INVENTION

An object of the present invention is to provide an electrophotographic printing plate precursor which is suitable to the development by the direct electrical supply system, and is excellent in the water-resistance and the mechanical strength.

Another object of the present invention is to provide a method for development of the above electrophotographic printing plate precursor.

It was found that the above-described problems can be solved by the following construction according to the present invention, and the above objects can be achieved by the following construction.

(1) An electrophotographic printing plate precursor which comprises an electrically conductive support having thereon a photoconductive layer and a back layer, said back layer being provided on the surface (side) of the support opposite to the photoconductive layer, wherein the back layer comprises at least an outermost layer having a surface resistivity of from $1\times10^{10}$ to $1\times10^{14}$ Ω and an inner layer having a surface resistivity of less than $1\times10^{10}$ Ω.

(2) A method for developing an electrophotographic printing plate precursor, which comprises placing an electrode so as to face an photoconductive layer of the electrophotographic printing plate precursor as described in (1) above, supplying a developing solution between the electrode and the photoconductive layer, and wet developing the electrophotographic printing plate precursor while contacting an electrically conductive element with the back layer of the electrophotographic printing plate precursor.

BRIEF DESCRIPTION OF THE DRAWINGS

FIGURE is a drawing showing the principle of the development method by a direct electrical supply system which is preferably used in the present invention.

DETAILED DESCRIPTION OF THE INVENTION

In the present invention, the back layer is composed of at least an outermost layer having a high surface resistivity (hereinafter, sometimes referred to as A layer) and an inner layer having a low resistivity (hereinafter, sometimes referred to as B layer). In the present invention, the surface resistivity of the outermost layer (A layer) is from $1\times10^{10}$ to $1\times10^{14}$ Ω, preferably from $1\times10^{10}$ to $1\times10^{13}$ Ω, and more preferably from $1\times10^{10}$ to $1\times10^{12}$ Ω. The surface resistivity of the inner layer (B layer) is less than $1\times10^{10}$ Ω, preferably from $1\times10^{5}$ to $1\times10^{10}$ Ω, and more preferably from $1\times10^{6}$ to $1\times10^{9}$ Ω.

The surface resistivity in the present invention is defined according to the description of "JIS 6911". More specifically, it can be measured, for example, by P-616 type measurement electrode (produced by Kawaguchi Electric Manufacturing Co., Ltd.) and Universal Electrometer Model ("MMII-17A" produced by Kawaguchi Electric Manufacturing Co., Ltd.).

In the present invention, A layer and B layer may be any construction as long as the surface resistivities thereof are within the ranges as defined above. Each of A layer and B layer may be a single layer or may be a plural layer construction. More specifically, the surface resistivity of A layer and B layer can be adjusted by appropriately selecting the type and amount of an electrically conductive material, and the type and amount of various additives. Examples of the additives include various hydrophilic polymers, water-resistant materials, water-resistant organic solvent materials and synthetic emulsions.

Examples of the above-described electrically conductive materials include colloidal alumina, colloidal silica, carbon black, metals such as Al, Zn, Ag, Fe, Cu, Mn and Co, metal salts such as chlorides, bromide, sulfates, nitrates and oxalates of the above-described metals, surface active agents (alkylphosphoric acid alkanolamine salt, polyoxyethylene alkylphosphates, polyoxyethylene alkyl ethers, alkylmethyl ammonium salt, N,N-bis(2-hydroxyethyl)alkylamine, alkyl sulfonates, alkyl benzenesulfonates, a fatty acid choline ester, a polyoxyethylene alkyl ether and a phosphoric acid ester thereof and a salt thereof, a fatty acid monoglyceride, a fatty acid and a sorbitan partial ester), a metal oxide (for example, ZnO, $SnO_2$ and $In_2O_3$), a cationic polymer electrolyte, and an anionic polymer electrolyte.

Examples of the above cationic polymer electrolyte include the following compounds:

I. Ammonium

1. Primary, secondary and tertiary ammonium salts polyethylene imine hydrochloride poly(N-methyl-4-vinylpyridinium chloride)

2. Quaternary ammonium salt poly(2-methacryloxyethyl trimethyl ammonium chloride)

poly(2-hydroxy-3-methacryloxypropyl trimethyl ammonium chloride)

poly(N-acrylamidopropyl-3-trimethyl ammonium chloride)

poly(N-methylvinylpyridinium chloride)

poly(N-vinyl-2,3-dimethylimidazolinium chloride)

poly(diallyl ammonium chloride)

poly(N,N-dimethyl-3,5-methylenepiperidinium chloride)

II. Sulfonium poly(2-acryloxyethyldimethyl sulfonium chloride)

III. Phosphonium poly(glycidyltributyl phosphonium chloride)

Examples of the above-described anionic polymer electrolyte include the following compounds:

I. Carboxylate poly(meth)acrylic acid polyacrylic acid ester hydrolyzate polyacrylic acid amide hydrolyzate polyacrylic acid nitrile hydrolyzate II. Sulfonate polystyrene sulfonate polyvinyl sulfonate III. Phosphonate polyvinyl phosphonate As the above-described electroconductive material, it is preferred to use fine particles of crystalline oxide or a complex oxide thereof or carbon black (refer to French Patent No. 2,277,136 and U.S. Pat. No. 3,597,272). Among these, electrically conductive carbon black is advantageous since it provides the desired electrical conductivity in a small amount thereof and it has a good miscibility with other various additives.

The electroconductive material may be used in an amount which provides the desired surface resistivity in the above-described range in each of A layer and B layer of the back layer. The amount of the electroconductive material used varies depending upon the type of each of the additives and the electroconductive material and, hence, is not defined by specific numerical values, but, as a general measure, the amount is in the range of generally from 0 to 10% by weight in A layer of the back layer and in the range of generally from 0 to 30% by weight in B layer of the back layer.

In the present invention, an underlayer can be provided between the electrically conductive support and the photoconductive layer, if desired. The underlayer is preferably adjusted to a surface resistivity of preferably from $1\times10^8$ to $1\times10^{14}$ Ω, more preferably from $1\times10^8$ to $1\times10^{12}$ Ω, and most preferably from $1\times10^8$ to $1\times10^{10}$ Ω. By providing such an underlayer, generation of a toner-defect portion by spark marks due to discharge (pin-holes) can be prevented, and also generation of fogs can be prevented. The underlayer according to the present invention can be any construction as long as it has the surface resistivity in the above-described range. More specifically, the surface resistivity of the underlayer in the above range can be determined by appropriately selecting the type and the amount of each of the electroconductive materials and various additives. The examples of the above-described additives include various water-resistant materials, water-resistant organic solvent materials and synthetic emulsions. Specific examples of these electrically conductive materials and various additives include those described for the back layer.

The amount of the electrically conductive material used in the underlayer may be any amount as long as the surface resistivity of the underlayer falls within the above range. The amount varies depending upon the type of various additives and electrically conductive materials and cannot be defined by specific numerical values, but, as a general measure, the amount of the electrically conductive material for the underlayer is generally from 0 to about 20% by weight.

The hydrophilic polymers used in the present invention may be any of known natural or synthetic hydrophilic polymers. Specific examples thereof include gelatins such as general lime-treated gelatin as well as acid-treated gelatin, modified gelatin and gelatin derivatives albumin; water-soluble derivatives of celluloses such as sodium alginate, gum arabic, cellulose, hydroxyethyl cellulose and carboxymethyl cellulose and starch; and hydrophilic polymers such as polyvinyl alcohol, polyvinyl pyrrolidone, polyacrylamide, styrene-maleic anhydride copolymer. These hydrophilic polymers may be used alone or in a combination of two or more polymers. The mechanical strength of the back layer can further be improved by addition of a colloidal, stable dispersion of fine particles of hydrophilic materials such as hydrophilic colloid particles (silica ($SiO_2$), alumina ($Al_2O_3$)), and zeolite.

Examples of water-resistant materials include water-resistant film-forming materials such as polyvinyl chloride, an acrylic resin, polystyrene, polyethylene, an alkyd resin, a styrene-butadiene copolymer and an ethylene-vinyl acetate copolymer, and organic solvent-resistant film-forming materials such as starch, oxidized starch, PVA, methyl cellulose, hydroxyethyl cellulose and carboxymethyl cellulose (CMC).

Examples of the water-resistant organic solvent materials which can be used include an ethylene-vinyl alcohol copolymer, a polyester having a high degree of polymerization and a polyurethane having a high degree of polymerization. Further, starch, polyvinyl alcohol (PVA), an acrylic resin (a reactive acrylic resin which may be an organic solvent solution type or an O/W type emulsion) or an alkyd resin (an air-hardening type) may be used in the form of a water-resistant, organic solvent-resistant material in combination with a crosslinking agent such as a melamine resin.

Examples of synthetic emulsions include those obtained by an emulsion polymerization or emulsion copolymerization of a monomer or prepolymer such as an acrylate, a methacrylate, vinyl chloride, vinylidene chloride, vinyl acetate, a polyurethane, acrylonitrile, butadiene and styrene-butadiene.

These materials for forming the back layer and the underlayer can be used in combination. If desired, a dispersing agent, a leveling agent or a crosslinking agent may further be added thereto.

Further, a hydrophilic polymer binder, for example, an organic titanium compound may be added to either A layer or B layer or both, and the underlayer so as to improve adhesion of the both layers.

In the present invention, the thickness of A layer and B layer is not restricted as long as the thickness is suitable for exhibiting the intended performance. The thickness of A layer is not specifically limited, but can be from about 0.5 to about 10 μm, and the thickness of B layer can be from about 2 to about 25 μm. When each of A layer and B layer is composed of a multiple layer structure, the total thickness of A layer or B layer can be in the above range. The total thickness of the back layer including A layer and B layer is generally in the range of generally from about 3 to about 25 μm and, preferably, from 8 to 15 μm. The thickness of the underlayer is generally from about 3 to about 25 μm and, preferably, from 8 to 15 μm.

The electrically conductive support used in the present invention may be any of water-absorbable supports generally used in the electrophotographic printing plate precursors. For example, a substrate such as paper and a plastic sheet, the substrate which has been subjected to an electrically conductive treatment by impregnating the substrate with a low resistant material, the above-described support having provided on the surface thereof with a water-resistant adhesive layer or at least one precoat layer, or a laminate composed of a plastic substrate which has been rendered electrically conductive by vapor-deposition of aluminum and a paper.

Specific examples of electrically conductive substrates or materials for making the substrate electrically conductive used for the electrically conductive support are those described in Yukio Sakamoto, *Denshi-shashin* (Electrophotography), 14, (No. 1), pp2–11 (1975), Hiroyuki Moriga, *Nyumon Tokushu-shi no Kagaku* (Introduction of Chemistry of Special Papers), Kobunshi Kankokai (1975), M. P. Hover, *J. Macromol. Sci. Chem.*, A-4(6), pp1327–1417 (1970).

The photoconductive layer used in the present invention contains at least a photoconductive material and a binder, and the photoconductive material may be an inorganic material or an organic material. Examples of inorganic photoconductive material include Si, Ge, zinc oxide, cadmium sulfide, titanium oxide, selenium, cadmium selenide, zinc selenide or lead oxide, a Se-Te alloy, a chalcogen alloy such as $As_2S_3$ and $As_2Se_3$.

Examples of the organic photoconductive material include photoconductive cyanine type pigments, photoconductive quinoline type pigments, photoconductive phthalocyanine type pigments, photoconductive pyrylium salt type pigments, substituted vinyloxazoles, triphenylamine derivatives, anthracenes, benzo-condensed heterocyclic rings pyrazoline or imidazole derivatives, oxadiazole derivatives, vinyl aromatic polymers and copolymer products thereof, fluorenone derivatives, polyarylalkanes such as triarylmethane leuco dyes and squarylium acid derivative dyes, perylene, tethracene, carbazole, tetrabenzyl-p-phenylenediamine, squarylium, indigo, dimethylperimide, polyvinyltethracene, polyvinylperylene, acrylhydrazone derivatives, benzthiazole derivatives, tetracyanopyrene and chlorocyan blue. These materials can be used in combination.

Examples of the binder which can be used include a silicone resin, polystyrene, polyacrylate or polymethacrylate, polyvinyl acetate, polyvinyl chloride, polyvinyl butyral and derivatives thereof as well as conventional materials used as binders for the photoconductive layer. The photoconductive material is used at a weight ratio of the photoconductive to the binder (weight ratio) in the range of from 3:1 to 20:1, but in the present invention the amount is not specifically restricted. Further, if desired, a sensitizing agent, a coating aid used in carrying out the coating, and other additives can also be added.

The thickness of the photoconductive layer is generally from 5 to 30 μm, but is not specifically limited in the present invention. Also, in order to improve the adhesiveness between the photoconductive layer and the underlayer, the surface of the underlayer is preferably previously subjected to a surface treatment such as corona discharge treatment, a glow discharge treatment, a flame treatment, a ultraviolet ray treatment, an ozone treatment and a plasma treatment as described in, for example, U.S. Pat. No. 3,411,908.

The printing plate precursor of the present invention can be prepared by a conventional technique well-known in the field of the preparation of electrophotographic printing plate precursors, and, as an ordinary dispersing system, for example, a ball mill, a colloid mill, an ultrasonic dispersing machine, a three-roll mill, a grain mill, a homogenizer and a homomixer can be used. Also, an air-knife coater, a trailing-blade coater, a wire-bar coater, a reverse-roll coater, a kiss-roll coater and a fountain coater can be used as a coating system.

The above-described precursor according to the present invention is converted into a printing plate through conventional steps such as charging, imagewise exposure and development. Also, it is suitable to the development by the direct electrical supply system described above.

In the present invention, any wet-development method can be applied for the development, but the method according to the present invention based on the principle figure of the direct electrical supply system shown in FIG. 1 is preferred.

In the development method according to the present invention shown in FIG. 1, an electrically conductive element 1 is contacted with a surface 2 of A layer of the back layer, and a surface 3 of the photoconductive layer is faced an electrode 4. A voltage is applied between the electrode 4 and the electrically conductive element 1 in such a manner that the electrode 4 becomes a positive electrode and the electrically conductive element 1 becomes a negative electrode. If necessary, the positive charge on the surface 2 of A layer of the back layer is rapidly neutralized by electrons directly supplied from the electrically conductive element 1 or the earth 5, and, as a result, a toner (+) adheres rapidly to the photoconductive layer 3 (−) and then is neutralized.

According to the above function, even in a so-called solid image, a more uniform solid image which is free from a portion where no toner is adhered can be obtained, and yet a development rate is accelerated.

The present invention is further illustrated in greater detail by the following examples, but these examples are not construed to limit the present invention.

EXAMPLE 1

Preparation of Compositions A to H

A coating material as a composition for the underlayer and a back layer was prepared according to the following formulation (1) to obtain a composition A.

Formulation (1)

| | Parts by Weight |
|---|---|
| SBR latex (a 50 wt % aqueous dispersion) | 92 |
| Starch (a 40 wt % aqueous solution) | 58 |
| Clay (a 45 wt % aqueous dispersion) | 110 |
| Melamine (a 80 wt % aqueous solution) | 5 |
| Water | 179 |

The composition A prepared above was coated on a polyethylene terephthalate (PET) support, and the surface resistivity of the coated film (thickness: 10 μm) was measured. The results are shown in Table 1 below. The measurement of the surface resistivity was performed by using P-616 Type Measurement Electrode Apparatus produced by Kawaguchi Seisakusho.

A coating material was prepared according to the following formulation (2), and coated films were formed in the same manner as described above for Composition A except for changing the amount of carbon black as shown in Table 1. Then, the surface resistivity of the coated films was measured to obtain 7 types of samples comprising Compositions B to H which are different from each other in the surface resistivity. The amount Of carbon black added in each of the composition and the surface resistivity of a single coated film are shown in Table 1 below.

Formulation (2)

| | Parts by Weight |
|---|---|
| SBR latex (a 50 wt % aqueous dispersion) | 92 |
| Clay (a 45 wt % aqueous dispersion) | 110 |
| Melamine (a 80 wt % aqueous solution) | 5 |
| Carbon black | 0 to 40 |
| Water | 191 |

TABLE 1

| Type of Composition | Amount of Carbon Black Added | Surface Resistivity (Ω) |
|---|---|---|
| A | — | $6.75 \times 10^8$ |
| B | 40 parts by weight | $6.45 \times 10^6$ |
| C | 30 parts by weight | $3.55 \times 10^7$ |
| D | 19 parts by weight | $1.87 \times 10^8$ |
| E | 10 parts by weight | $2.34 \times 10^9$ |
| F | 7 parts by weight | 4.51 × 1010 |
| G | 5 parts by weight | 6.36 × 1011 |
| H | 0 parts by weight | 5.61 × 1012 |

Preparation of Electrophotographic Printing Plate Precursor

A high quality paper having a basis weight of 100 g/m$^2$ was used as a support, and the above-described composition H was coated on one side of the paper in a dry coating amount of 10 g/m$^2$ to form an underlayer. Then, on the surface opposite to the underlayer, each of the above-described compositions A to H were coated in a dry coating amount of 5 g/m$^2$ to form an inner layer of the back layer. Each of the samples having coated with the inner layer of the back layer was further coated with each of the above-described compositions A to H in a dry coating amount of 5 g/m$^2$ to form an outermost layer of the back layer to obtain a total of 64 types of supports having the underlayer and the back layers. Then, a composition for the photoconductive layer shown in the following Formulation (3) was coated on the underlayer of the support in a dry coating amount of 23 g/m$^2$ to prepare various electrophotographic printing plate precursors.

Formulation (3)

| | Parts by Weight |
|---|---|
| Photoconductive zinc oxide ("SAZEX 2000" manufactured by Sakai Chemical Industry Co., Ltd.) | 100 |
| Silicone Resin ("KR211" manufactured by Shin-Etsu Chemical Co., Ltd.) | 35 |
| Rose Bengale | 0.1 |
| Fluorescein | 0.2 |
| Methanol | 10 |
| Toluene | 150 |

The 64 types of electrophotographic printing plate precursors thus-obtained were evaluated on their performance in the following manner.

Image Reproducibility

The resulting electrophotographic printing plate precursor was charged and imagewise exposed, and then subjected to a wet-development by the direct electrical supply system using a test machine based on the principle shown in FIG. 1 in which an electrically conductive element made by steel was contacted with the back layer. In order to investigate the uniformity of the solid image, the imagewise exposure was performed using an original in which a black sheet having a size of 185 mm×257 mm (B5 size) was pasted at the center of the original. The resulting sample was evaluated on the uniformity by measuring the density in the solid image using Macbeth densitometer.

Strength

Using a testing machine which is capable of scratching with a needle tip under a constant load, ("HEIDON 14" produced by Shinto Kagaku Co., Ltd.), the back layer surface of the sample was scratched with a needle having a needle diameter of 0.1 mm under a load of 50 g, and the resulting scratches were evaluated.

The result's obtained are shown in Table 2 below.

TABLE 2

| Composition of Inner Layer | Composition of Outermost Layer A | B | C | D | E | F | G | H |
|---|---|---|---|---|---|---|---|---|
| A | GE* | GB | GB | GB | GM | GE* | GE* | GE* |
| B | GE* | GB | GB | GB | GM | GG* | GE* | GE* |
| C | GE* | GB | GB | GB | GM | GG* | GE* | GE* |
| D | GE* | GB | GB | GB | GM | GG* | GE* | GE* |
| E | GE* | GB | GB | GB | GM | GG* | GE* | GE* |
| F | GE* | GB | GB | GB | GM | ME | BE | BE |
| G | GE* | GB | GB | GB | MM | BE | BE | BE |
| H | GE* | GB | GB | GB | BM | BE | BE | BE |

The left column in each of the data shown in Table 2 stands for the results of evaluation on the uniformity in the density of solid image, and the criterion of the evaluation are as follows:

G: Difference between the maximum density portion and the minimum density portion is 0.05 or less.

M: Difference between the maximum density portion and the minimum density portion is from 0.06 to 0.09.

B: Difference between the maximum density portion and the minimum density portion is 0.10 or more.

The right column in each of the data shown in Table 2 stands for the results of evaluation on the film strength of the back layer, and the criterion of the evaluation are as follows:

E: Substantially not scratched.

G: Scratched but not reaching to the lower layer.

M: Scratched, and about half length of scratches reaches to the lower layer.

B: All the scratched portions reach to the lower layer.

As is apparent from the results of Table 2, when Composition A is used for the outermost layer even if the composition for the inner layer is any of those compositions, the excellent mechanical strength and image uniformity can be obtained. It is thought that the reason is that the surface resistivity is decreased since the carbon black decreasing the strength of the back layer is not contained in Composition A.

As is apparent from the results of Table 2, when Compositions F to H are used for the outermost layer of the back layer and Compositions A to E are used for the inner layer, the excellent mechanical strength and image uniformity can be obtained. It is thought that the reason is that the electrical conductivity and the mechanical strength of the back layer are consistent as the surface resistivities of the outermost and inner layers of the back layer are within the scope of the present invention.

On the other hand, when the surface resistivity of the outermost layer the back layer is less than $10^{10}$ Ω and the surface resistivity of the inner layer of the back layer is $10^{10}$ to $10^{14}$ Ω, the mechanical strength is insufficient though the image is good.

Then, the electrophotographic printing plate precursors showing good image uniformity and strength in Table 2 above (shown by asterisks(*)) were further tested for water-absorbability.

Water-Absorption Property

The water-absorption was measured according to the Kobb Test defined in *Test Method for Water-Absorption of Paper and Cardboard*, JIS P-8140, and the results obtained are shown in the upper line in Table 3 below.

Further, wrinkle of printed papers was investigated by imagewise exposing and developing the printing plate precursor, subjecting the resulting printing plate to an oil-desensitizing treatment by an etching solution ELP-E2 and an etching processor ELP-E380, and printing by 3200 Type Printer (produced by Ryobi Ltd.). The wrinkle was evaluated by counting the number of prints until wrinkle was generated in prints, and the results obtained are shown in the lower line in Table 3 below.

TABLE 3

| Composition of Inner Layer | Composition of Outermost Layer A | F | G | H |
|---|---|---|---|---|
| A | 46.1 | 1.8 | 1.8 | 1.8 |
| | 750 | * | * | * |
| B | 15.3 | 2.1 | 1.5 | 1.1 |
| | 1200 | * | * | * |
| C | 12.7 | 2.9 | 2.3 | 0.9 |
| | 1000 | * | * | * |
| D | 9.5 | 2.4 | 2.5 | 1.0 |
| | 1350 | * | * | * |
| E | 13.8 | 1.3 | 2.0 | 1.1 |
| | 1100 | * | * | * |
| F | 7.6 | | | |
| | 1200 | | | |
| G | 8.5 | | | |
| | 1400 | | | |
| H | 5.6 | | | |
| | 1350 | | | |

Note:
The upper line in Table 3: Value of water-absorption in $g/m^2 \cdot 45$ minutes.

The lower line in Table 3: Number of prints until generation of wrinkle, or an asterisk (*) indicating that no wrinkle was generated until 3,000 prints.

As is apparent from Table 3, it was confirmed that the printing plate precursors provided with the outermost layer and the inner layer of the back layer having the surface resistivity in the range of the present invention show good water-resistance and printing durability in addition to the above-described mechanical strength and uniformity of image.

While the invention has been described in detail and with reference to specific embodiments thereof, it will be apparent to one skilled in the art that various changes and modifications can be made therein without departing from the spirit and scope thereof.

What is claimed is:

1. A method for developing an electrophotographic printing plate precursor, which comprises placing an electrode so as to face a latent electrostatic image bearing photoconductive layer of the electrophotographic printing plate precursor which comprises an electrically conductive support having thereon a photoconductive layer and a back layer, said back layer being provided on the surface of said support opposite to said photoconductive layer, wherein said back layer comprises at least an outermost layer having a surface resistivity of from $1\times10^{10}$ to $1\times10^{14}\Omega$ and an inner layer having a surface resistivity of less than $1\times10^{10}\Omega$, supplying a developing solution between said electrode and said photoconductive layer, and wet developing the electrophotographic printing plate precursor while contacting an electrically conductive element with the back layer of the electrophotographic printing plate precursor.

2. The method for developing an electrophotographic printing plate precursor as claimed in claim 1, wherein said outermost layer has a surface resistivity of from $1\times10^{10}$ to $1\times10^{13}\Omega$.

3. The method for developing an electrophotographic printing plate precursor as claimed in claim 1, wherein said inner layer has a surface resistivity from $1\times10^{5}$ to $1\times10^{10}\Omega$.

4. The method for developing an electrophotographic printing plate precursor as claimed in claim 1, wherein an underlayer is provided between said electrically conductive support and said photoconductive layer.

* * * * *